US006075954A

United States Patent [19]

Ogata et al.

[11] Patent Number: 6,075,954

[45] Date of Patent: Jun. 13, 2000

[54] TONER DENSITY CONTROL DEVICE

[75] Inventors: Takao Ogata, Susono; Kazuhiro Hasegawa, Numazu, both of Japan

[73] Assignee: Canon Kabushiki Kaisha, Tokyo, Japan

[21] Appl. No.: 09/312,830

[22] Filed: May 17, 1999

[30] Foreign Application Priority Data

May 22, 1998 [JP] Japan ..... 10-158361

[51] Int. Cl.[7] ..... G03G 15/08

[52] U.S. Cl. ..... 399/60; 399/72

[58] Field of Search ..... 399/27, 49, 60, 399/72, 74

[56] References Cited

U.S. PATENT DOCUMENTS 5,253,018 10/1993 Takeuchi et al. ..... 399/49
5,349,377 9/1994 Gilliland et al. ..... 399/181 X
5,469,244 11/1995 Ogata et al. ..... 399/30
5,559,587 9/1996 Ogata et al. ..... 399/60
5,579,090 11/1996 Sasanuma et al. ..... 399/49
5,819,132 10/1998 Hirobe ..... 399/49
5,950,043 9/1999 Fujita et al. ..... 399/60

*Primary Examiner*—Fred L. Braun
*Attorney, Agent, or Firm*—Fitzpatrick, Cella, Harper & Scinto

[57] ABSTRACT

A toner density a control device which has first toner density control device and a second toner density control device including a detecting member and, in case the density of the image detected by the detecting member changes by not less than a predetermined value with respect to a standard density, a ratio of the number of density controls by the second density control device with respect to the number of image formations changes.

14 Claims, 9 Drawing Sheets

TONER DENSITY CONTROL DEVICE

BACKGROUND OF THE INVENTION

1. Field of the Invention

The present invention relates to an electrophotographic image forming apparatus such as a copying machine or a printer, and more particularly to the toner density control in the developing device thereof.

2. Related Background Art

FIG. 8 is a schematic cross-sectional view of a color image forming apparatus.

This image forming apparatus is provided with a digital color image reader portion in the upper part and a digital color image printer portion in the lower part thereof.

In the reader portion, an original 30 is placed on an original supporting glass plate 31 and is scanned by an exposure lamp 32, and the light reflected from the original 30 is focused by a lens 33 onto a full-color sensor 34 to obtain color separated image signals, which are supplied through an unrepresented amplifying circuit, processed in a video process unit and supplied to the printer portion.

In the printer portion, a photosensitive drum 1 constituting an image bearing member is supported rotatably in a direction R1, and, around the photosensitive drum 1, there are provided a pre-exposure lamp 11, a corona charging device 2, an exposure optical system 3, a potential sensor 12, four developing units 4Y (yellow), 4C (cyan), 4M (magenta) and 4K (black), an on-drum toner detecting means (sensor) 13, a transfer unit 5 and a cleaning device 6. The laser beam exposure optical system 3 receives the image signals from the reader portion and converts the signals into an optical signal by a laser output portion (not shown). The laser beam is reflected by a polygon mirror 3*a*, then guide by lens 3*b* and mirror 3*c* and is converted into an optical image E which linearly scans (raster scan) the surface of the photosensitive drum 1.

At the image formation in the printer portion, the photosensitive drum 1 is rotated in the direction R1, at first subjected to charge elimination by the pre-exposure lamp 11, then uniformly charged by the charging device 2 and is irradiated with the optical image E of each separated color to form a latent image. Then, for each separated color, a predetermined developing unit is activated to develop the latent image on the photosensitive drum 1, thereby forming an image with toner, principally composed of a resinous material, on the photosensitive drum 1. In this operation, the latent image is developed with the developer, utilizing an electric field formed in the developing area.

The developing units 4Y, 4C, 4M, 4K are so constructed that one unit corresponding to the separated color selectively approaches to the photosensitive drum 1 by the function of eccentric cams 24Y, 24C, 24M, 24K. The toner image on the photosensitive drum 1 is transferred onto a recording material, which is supplied from a cassette 7 (7*a*, 7*b* or 7*c*) through a conveyor system and the transfer device 5 to a position opposed to the photosensitive drum 1.

The transfer device 5 is provided in this example with a transfer drum 5*a*, a transfer charger 5*b*, an adsorption roller 5*g* opposed to an adsorption charger 5*c* for electrostatically absorbing (attracting) the recording material, an internal charger 5*d* and an external charger 5*e*. On the peripheral aperture of the rotatably supported transfer drum 5*a*, there is integrally adhered, in cylindrical shape, a recording material supporting sheet 5*f* consisting of a dielectric material. The recording material supporting sheet 5*f* is composed of a dielectric sheet such as a polycarbonate film.

With the rotation of the transfer drum 5*a*, the toner image on the photosensitive drum 1 is transferred, by the function of the transfer charger 5*b*, onto the recording material supported on the recording material supporting sheet 5*f*. In this manner the toner images of a desired number of colors are transferred onto the recording material, transported by the recording material supporting sheet 5*f* by attraction thereto, thereby forming a multi-color image.

In case of a four-color mode, after the transfer of the toner images of four colors, the recording material is separated from the transfer drum 5*a* by the function of a separating finger 8*a*, a separating push-up roller 8*b* and a separation charger 5*h*, then subjected to image fixation in a heat roller fixing device 9 and discharged to a tray 10. On the other hand, the photosensitive drum 1 after the image transfer is subjected to the cleaning of the surfacially remaining toner by the cleaning device 6 and is used again for image formation.

In case images are formed on both faces of the recording material, a transport path switching guide 19 is activated after the recording material is discharged from the fixing device 9 to introduce the recording material into an reversing path 21*a* through a vertical path 20. After the recording material is once stopped, an reversing roller 21*b* is reversed to advance the recording material in the opposite direction, with the trailing end of the sheet at the introducing operation as the leading end, whereby the recording material is stocked in an inverted state in an intermediate tray 22. Thereafter an image is formed on the other face through the image forming process explained above.

The recording material supporting sheet 5*f* of the transfer drum 5*a* is smeared by the toner scattered from the photosensitive drum 1, the developing units 4Y to 4K, the cleaning device 6 etc., toner deposition at the jamming of the recording material, the deposition of oil from the recording material at the image formation etc. It is cleaned however by a fur brush 14, a backup brush 15 opposed thereto across the recording material supporting sheet 5*f*, an oil removing roller 16 and a backup brush 17 opposed thereto across the recording material supporting sheet 5*f*, before it is subjected again to the image forming process. Such cleaning is executed at the pre-rotation step and the post-rotation step, and also when the sheet jamming occurs.

In the present example, the gap between the recording material supporting sheet 5*f* and the photosensitive drum 1 can be set at a predetermined value at a predetermined timing, by activating a transfer drum eccentric cam 25 to drive a cam follower 5*i* integral with the transfer drum 5*a*. It is thus possible, for example in a stand-by state or when the power supply is turned off, to separate the transfer drum 5*a* from the photosensitive drum 1, thereby separating the rotation of the transfer drum from the rotary drive of the photosensitive drum.

In the image forming operations described above, the developing units 4Y to 4K and a developer density control device function in the following manner. In FIG. 9, a developing unit 4 stands for any of the developing units 4Y to 4K, and there are shown developer agitating screws 42, 43 provided in the developing unit 4.

After the reading of the original 30 shown in FIG. 8 by a CCD and the formation of the electrostatic latent image on the photosensitive drum through the image forming steps, when such latent image reaches the developing position, a developing bias voltage, consisting of superposed AC and DC voltages, is applied by a developing bias source 40 to a developing sleeve 41 of the developing unit 4 shown in FIG.

4. At the same time, the developing sleeve 41 is rotated in a direction C by an unrepresented developing sleeve drive device and is pressed by a developing pressure cam 24 (24Y to 24K) so as to be positioned at a predetermined distance from the photosensitive drum 1, and the latent image is developed in such state.

At the same time, the input image signal read by the aforementioned CCD is subjected to A/D conversion, and the density level in each pixel is counted by a video counter (not shown). According to the accumulated value of the count, a CPU (not shown) determines the toner replenishment amount, and the toner is thus replenished from a hopper 44 to the developing device 4.

There may be employed, in addition, a developer density control device which detects the variation in the image density by the output voltage of a sensor. The image forming apparatus shown in FIG. 8 is provided with such control device, which forms the latent image of a predetermined patch image for density detection on the photosensitive drum 1, developing such latent image in the above-described manner to form a patch image, reading the density thereof with a sensor 13 and accordingly replenishing the toner from the hopper 44 to the developing device 4. Thus the developer density is so controlled that the patch image always has a constant density.

During the image forming process, the patch image is normally formed in a non-image area, and the developer density control utilizing such patch image is executed once in every tens of image forming cycles.

However, the toner replenishment amount to the developing device 4 (4Y to 4K) inevitably fluctuates by the toner refilling to the toner hopper 44 of the developing device 4 or by the individual fluctuation of the toner hopper 44 itself, whereby the toner replenishment of the desired amount cannot be achieved in stable manner, eventually leading to instability in the image density.

SUMMARY OF THE INVENTION

An object of the present invention is to provide a toner density control device capable of stably controlling the density of the toner in the developer.

Another object of the present invention is to provide a toner density control device allowing stable replenishment of the toner of the desired amount into the developing device, thereby enabling to securely obtain the image of an appropriate density, regardless of the presence of toner refilling to the toner hopper of the developing device or of the individual fluctuation in the toner hopper itself.

Still another object of the present invention is to provide a toner density control device comprising first toner density control means for controlling the density of the toner in the developer on the basis of the density information of the image signal, and second toner density control means including detecting means for detecting the density of a formed image and adapted for controlling the density of the toner in the developer on the basis of the image density detected by the detecting means, wherein, in case the image density detected by the detecting means changes by not less than a predetermined value with respect to a standard density (reference density), a ratio of the number of density controls by the second density control means with respect to the number of image formations changes.

Still another object of the present invention is to provide a toner density control device comprising first toner density control means for controlling the density of the toner in the developer on the basis of the density information of the image signal, second toner density control means including detecting means for detecting the density of a formed image and adapted for controlling the density of the toner in the developer on the basis of the image density detected by the detecting means, and remaining amount detecting means for detecting the remaining amount of the toner in a developer container, wherein a ratio of the number of density controls by the second density control means with respect to the number of image formations changes, according to the result of detection by the remaining amount detecting means.

Still other objects of the present invention, and the features thereof, will become fully apparent from the following detailed description which is to be taken in conjunction with the attached drawings.

DESCRIPTION OF THE PREFERRED EMBODIMENTS

In the following, the toner density control device of the present invention will be clarified in detail by embodiments thereof, with reference to the attached drawings.

Embodiment 1

Figure 1:
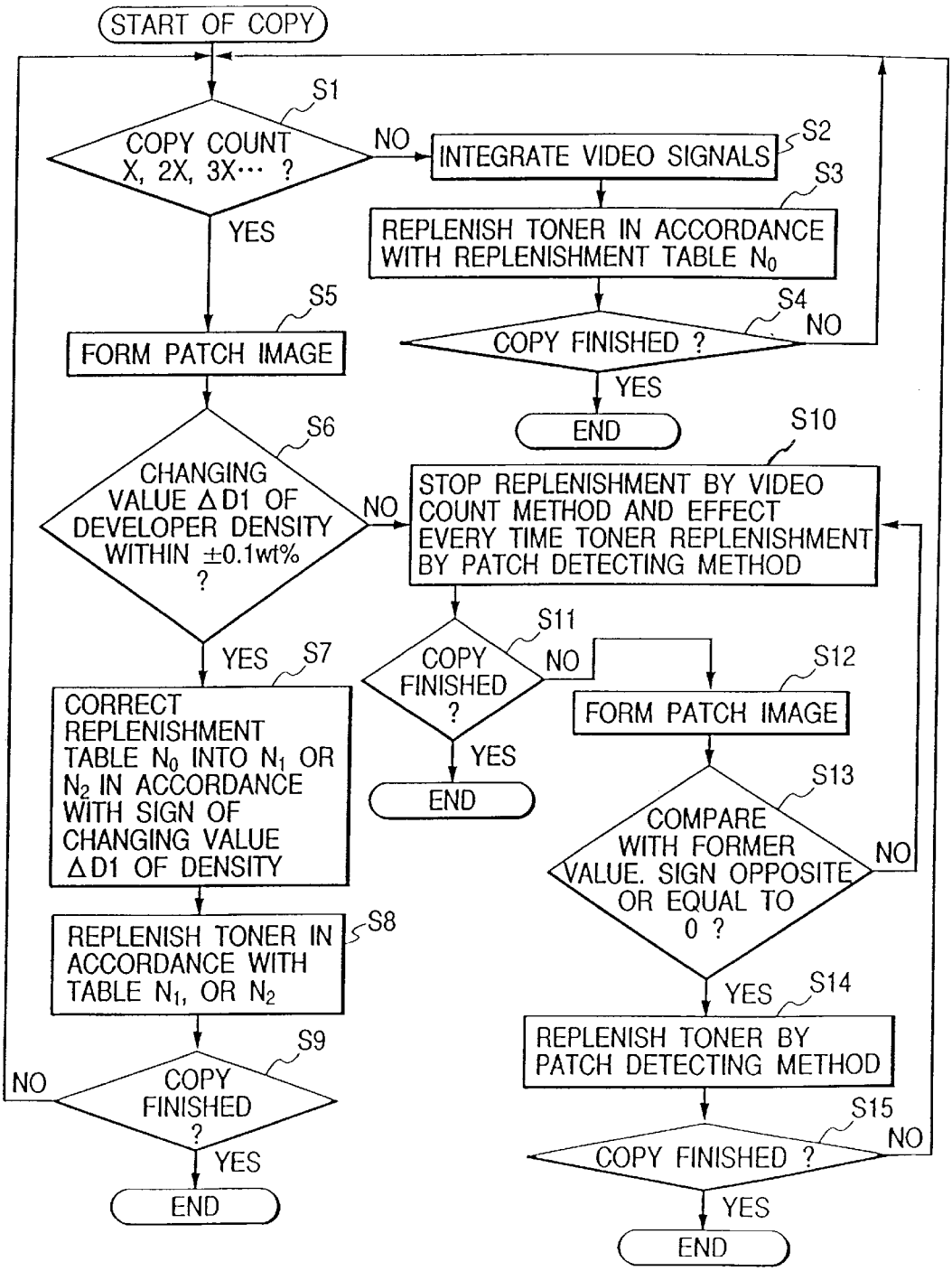
FIG. 1 is a flow chart showing a density control method in an embodiment of the image forming apparatus of the present invention.
Figure 8:
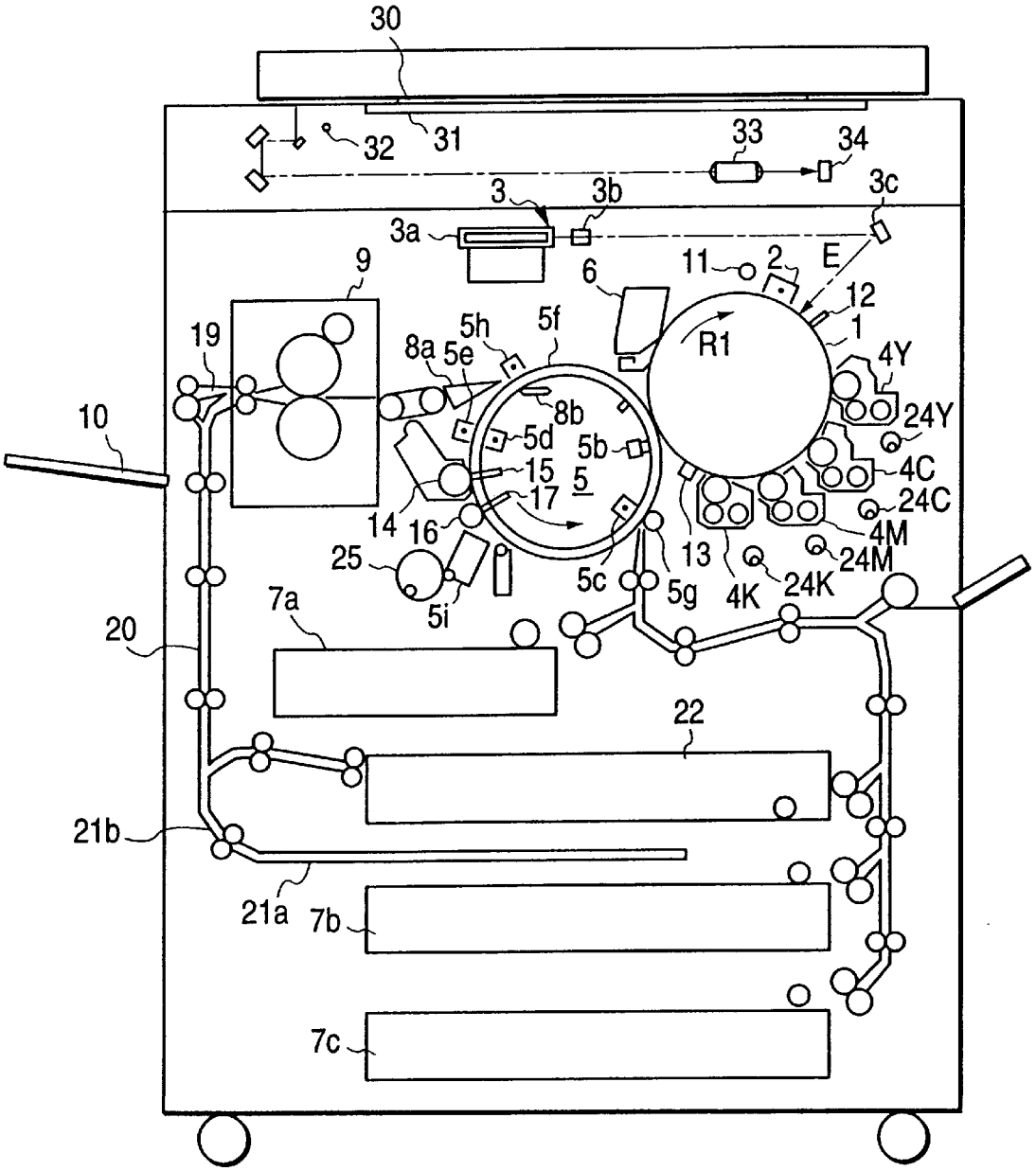
FIG. 8 is a schematic view of a conventional image forming apparatus.

FIG. 1 is a flow chart showing the density control method in an embodiment of the toner density control device of the present invention. The present invention is principally featured in the density control method, which is exploited in the image forming apparatus shown in FIG. 8. In the following, the description will be given on the features of the present invention, while the description of the entire configuration of the image forming apparatus and the functions thereof will be omitted.

The toner density control device of the present invention is provided with first developer density control means of a video count method for integrating the video signal of the original image and replenishing toner to a developing device utilizing two-component developer containing toner and carrier based on the integrated video signal thereby controlling the developer density in the developing device, and second developer density control means of a patch detection method for detecting the density of a density detection patch image formed on the image bearing member and replenishing the toner to the developing device according to the detected density thereby controlling the developer density in the developing device.

Figure 9:
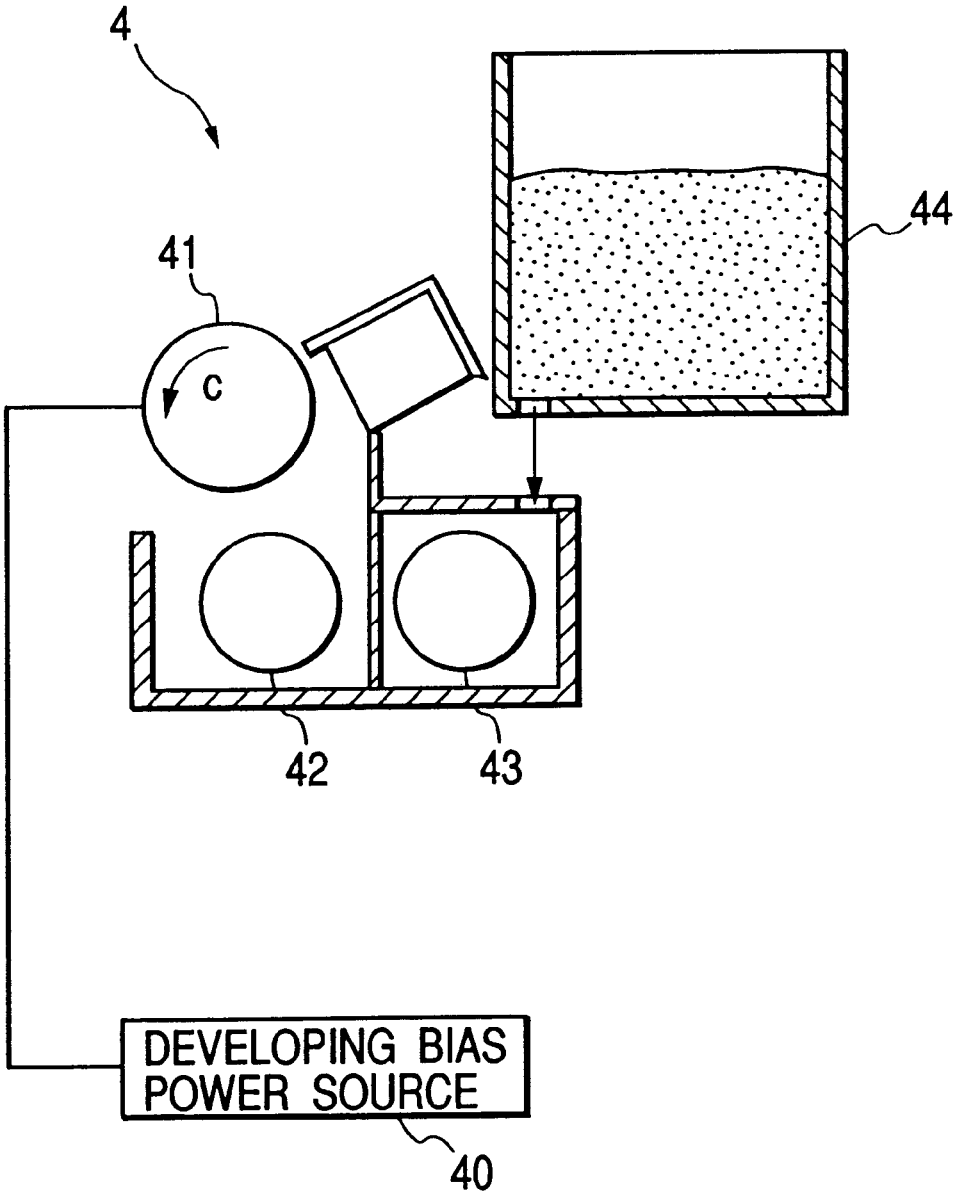
FIG. 9 is a cross-sectional view of a developing device provided in the image forming apparatus shown in FIG. 8.

As explained in the foregoing, in the developing device 4 (4Y to 4K) shown in FIG. 9, the toner replenishing ability thereto fluctuates for example after the toner refilling to the toner hopper 44. The present invention is to absorb such fluctuation in the toner replenishing ability, thereby maintaining a stable image density.

In the following there will be given an explanation, with reference to FIGS. 3 and 4, on the fluctuation in the toner supply amount to the developing device 4 at the toner refilling to the toner hopper 44.

Figure 3:
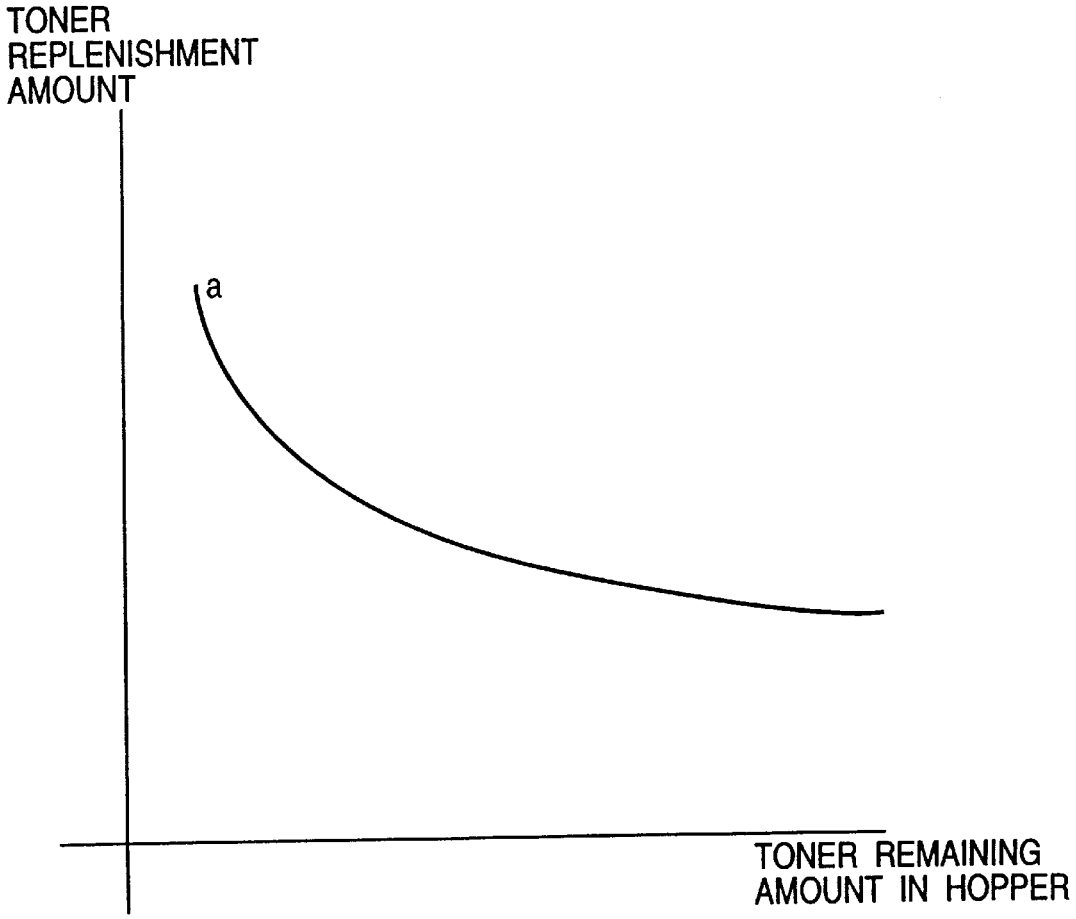
FIG. 3 is a schematic chart indicating that the toner replenishment amount from the hopper to the developing device increases immediately after the toner refilling to the toner hopper of the developing device in the image forming apparatus shown in FIG. 1.

Referring to FIG. 3, a curve a indicates the toner replenishment amount per unit time after the toner refilling. In a stationary state after the lapse of a certain time from the toner refilling, the toner replenishing amount from the hopper 44 to the developing device 4 is substantially constant, but, immediately after the toner refilling, the toner replenishing amount becomes larger as indicated by the curve a. This is because, as shown in FIG. 4, the toner T1 remaining in the hopper 44 is pressed by the refilled toner T2 and is tightened to a higher density.

Figure 4:
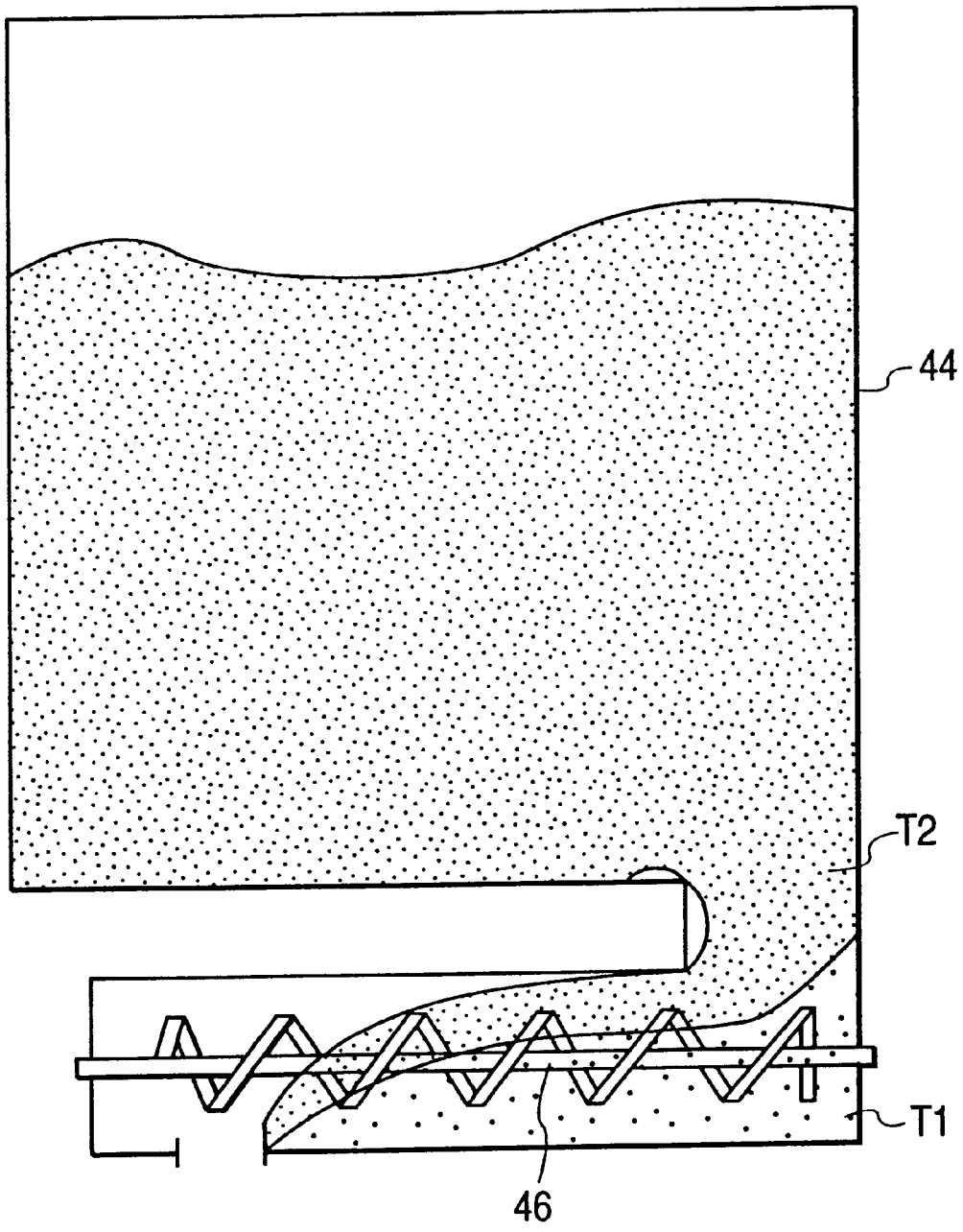
FIG. 4 is a cross-sectional view showing the toner state in a feeding portion of the toner hopper with refilled toner.

Consequently, in the toner hopper 44 shown in FIG. 4, the toner amount actually fed per unit time by a replenishing screw 46 becomes larger than the designed value, whereby the density of the two-component developer in the developing device 4 or the T/C ratio (=T/(T+C) in which T is the weight of the toner and C is the weight of the carrier) becomes significantly displaced from the initial target value.

In the present embodiment, therefore, if the variation in the T/C ratio (density) of the developer is within ±1.0 wt. % of the initial value, the density control is executed, as shown in FIG. 1, by the video count method by data feedback to a replenishment table of the video count method in the density control device with changes in the replenishment table, but, if the variation in the T/C ratio is in excess of ±1.0 wt. %, the density control by the video count method is replaced by the density control of a patch detection method.

In the following there will be given a detailed explanation on the density control in the present embodiment, in which the image forming sequence is executed in the conventional manner.

Figure 2:
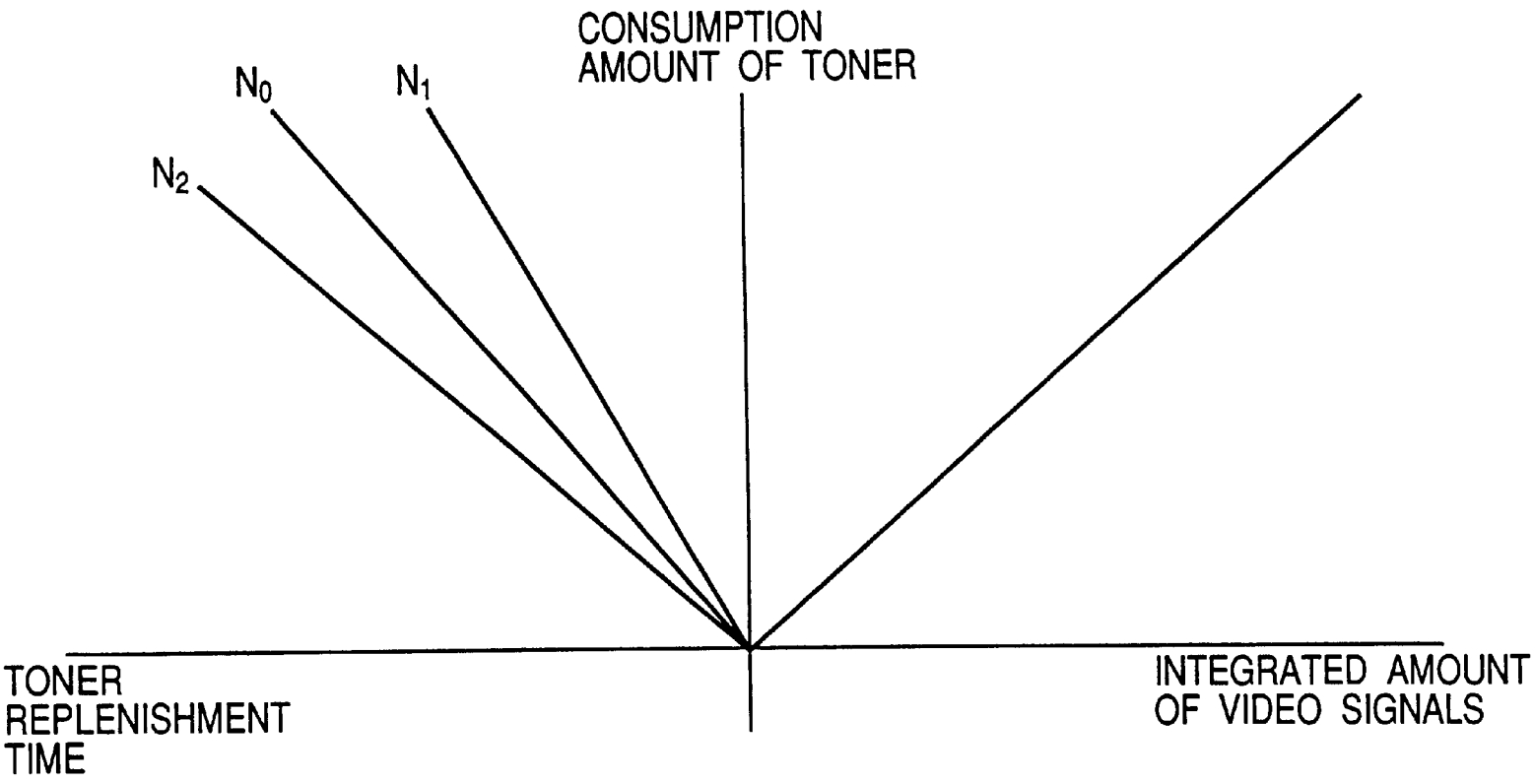
FIG. 2 is a schematic chart showing the relationship of the integrated video signal amount, the toner consumption amount, the replenishment table and the toner replenishment time to be used in a video count control method among the two control modes in the density control method shown in FIG. 1.

The image forming apparatus of the present embodiment is provided with a counter for counting the number of copies or the number of image formation of each color, and, when the count reaches a predetermined number X, forms a patch image and detects the developer density thereof. Between such detections, the image signal (video signal) obtained from the reader portion is integrated and the toner consumption amount corresponding to such integrated value is determined in advance (FIG. 2).

Referring to the flow chart shown in FIG. 1, when a copying operation (image formation) is started, a counter counts the number of copies in each developing color, and a step S1 discriminates whether the count is a multiple of X (X being for example 10; multiple being X, 2X, 3X, . . . ). If not equal to a multiple of X, a step S2 integrates the video signal, and the toner replenishment is executed at a replenishment time determined by a replenishment table $N_0$ (step S3). The copying operation is continued with the density control by the toner replenishment in the above-described video count method. A step S4 discriminates whether the copying of the preset number has been completed, and, if not, the sequence returns to the step S1 to repeat the above-described sequence from the step S1.

The toner replenishing time mentioned above is determined from FIG. 2. More specifically, the integrated video signal determines the toner consumption amount, and a corresponding replenishment table determines the toner replenishing time. At first a table $N_0$ is selected as the replenishment table.

If the step S1 identifies that the copy count is equal to X, a predetermined patch image is formed in a non-image area of the photosensitive drum 1 (S5). Then the sensor 13 detects the density of the patch image to detect the developer density (T/C ratio), then a density variation ΔD1 is determined from the detected developer density and a reference (initial) value (by subtracting the standard density from the detected density) and there is discriminated whether such variation ΔD1 is within ±1 wt. % of the standard density (S6).

As explained in the foregoing, immediately after the toner refilling into the toner hopper 44, the toner replenishment amount per unit time increases as indicated by the curve a in FIG. 3, thereby causing a variation in the developer density and rendering the image density unstable. In order to suppress such variation, the toner replenishment table is changed according to the flow chart shown in FIG. 1.

More specifically, if the above-mentioned variation ΔD1 is within ±1 wt. % of the standard density, there is executed a correction by changing the replenishment table $N_0$. The replenishment table is changed to $N_1$ or $N_2$ depending on the sign of ΔD1 , respectively if it is positive or negative (S7). In this manner it is rendered possible to reduce the fluctuation in the toner replenishment amount from the hopper 44 to the developing device 4.

The copying operation is continued with the density control by the toner replenishment with the replenishing time determined by thus changed replenishment table. A step S9 discriminates whether the copying of the preset number has been completed, and, if not, the sequence returns to the step S1 to repeat the above-described sequence from the step S1.

If the step S6 identifies that the density variation ΔD1 is in excess of ±1 wt. %, the toner replenishment amount is displaced from the designed value, so that the density variation continues to increase (namely density continues to depart from the appropriate value) and the control eventually becomes impossible, if the replenishment by the video count method is continued. Therefore, the sequence proceeds to a step S10 to interrupt the toner replenishment by the video count method and to execute the toner replenishment by the patch detection method every time.

Then the image formation is executed with the density control by the toner replenishment in the patch detection method as explained in the foregoing, and a step S11 discriminates whether the copying of the preset number has been completed. If not completed, there is formed a patch image (S12), then the density of the patch image is detected to determine the developer density, and there is discriminated whether the detected developer density is inverted in sign in comparison with the developer density detected in the step S6 or reduced to zero (S13). If not, the sequence returns to the step S10 and the subsequent sequence is repeated until the detected density is inverted in sign or reduced to zero. In this manner it is rendered possible to correct the variation in the developer density and to maintain stable image density.

If the step S13 identifies that the detected density has been inverted in sign or reduced to zero, a step S14 executes toner replenishment by the patch detection method, and the copying operation is continued with such density control. Then a step S15 discriminates whether the copying of the preset number has been completed, and, if not, the sequence returns to the step S1 to repeat the above-described sequence.

In the present embodiment, as explained in the foregoing, if the variation in the T/C ratio (density) of the developer is within ±1.0 wt. % of the initial value, the density control is executed with data feedback to the replenishment table of the first density control means of the video count method and with the change of the replenishment table (first control), but, if the variation in the T/C ratio of the developer is in excess of ±1.0 wt. %, the density control by the video count method is suspended and replaced by the density control with the toner replenishment by the second density control means of the patch detection method (second control). It is thus rendered possible to stably replenish the toner of the desired amount to the developing device 4 thereby securely obtaining the image of an appropriate density, regardless of the presence of the toner refilling into the toner hopper 44 or of the individual fluctuation in the toner hopper.

Embodiment 2

Figure 5:
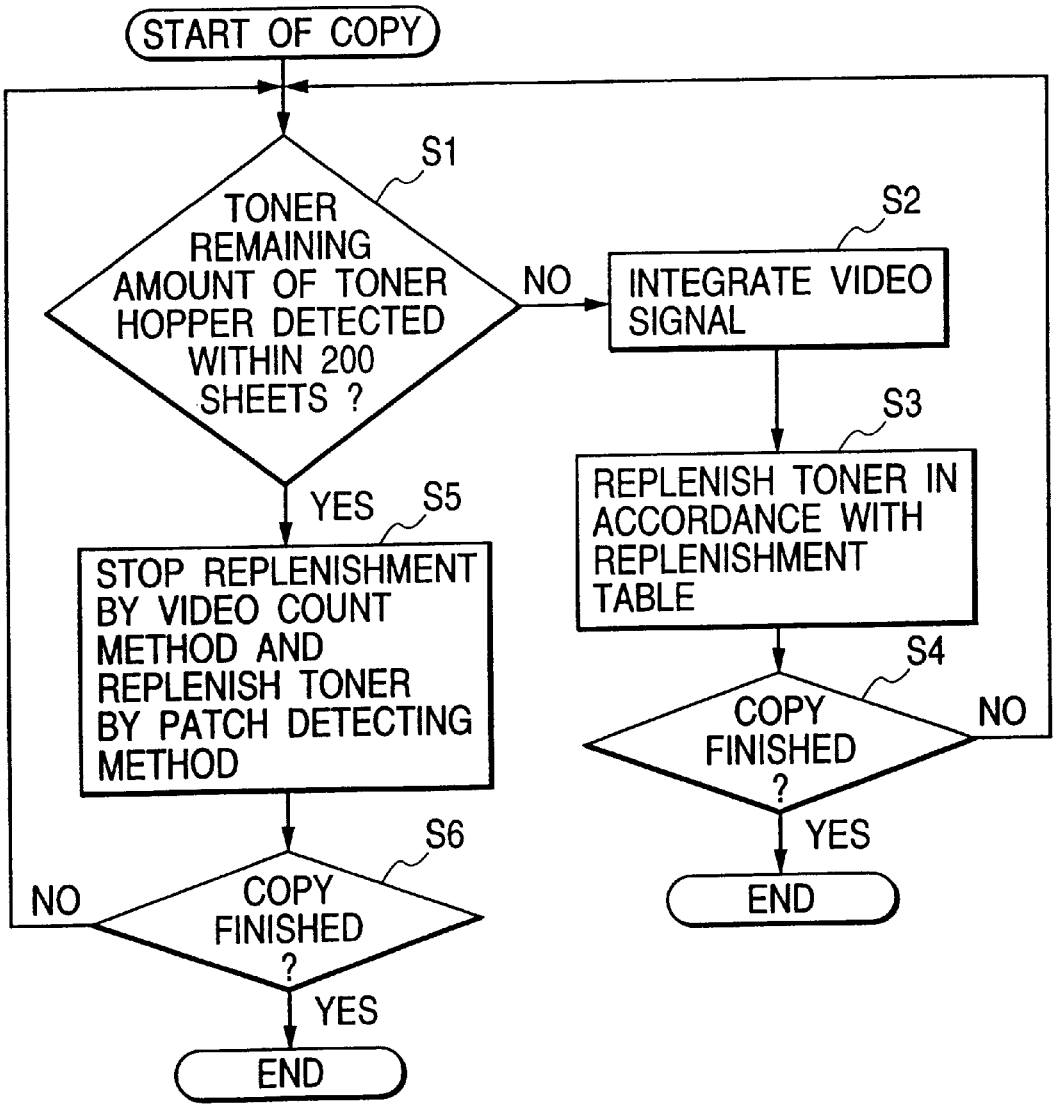
FIG. 5 is a flow chart showing the density control method in another embodiment of the present invention.

FIG. 5 is a flow chart of the density control in another embodiment of the present invention. This embodiment is featured by detecting the toner refilling in the toner hopper 44 shown in FIG. 4 by the user or the service personnel through detection of the remaining toner amount in the toner hopper 44, and, in anticipation of the variation of the toner replenishment from the toner hopper to the developing device 4 and the variation in the developer density, suspending and switching the toner replenishment and the density control by the video count method to those of the patch detection method.

Referring to the flow chart shown in FIG. 5, when a copying operation is started, a step S1 confirms whether the remaining toner amount in the toner hopper 44 has been detected. This step discriminates whether the remaining toner amount has been detected within a predetermined amount of copying operations, for example 200 copies. If not, the sequence proceeds as in the embodiment 1 to a step S2 to integrate the video signal and to execute the toner replenishment with the replenishing time determined by the table $N_0$ (S3). The copying operation is continued with the density control by the toner replenishment of the video count method. Then a step S4 discriminates whether the copying of the preset number has been completed, and, if not, the sequence returns to the step S1 to repeat the above-described sequence from the step S1.

If the step S1 identifies that the remaining toner amount has been detected within 200 copies, the toner replenishment by the video count method is suspended and replaced by the toner replenishment and the density control by the patch detection method (S5).

The toner replenishment by the patch detection method is executed, as described in the steps S10 to S15 of the embodiment 1, by forming a patch image in a non-image area of the photosensitive drum 1, detecting the density of the patch image to determine the developer density, comparing thus detected developer density with the previously detected developer density to discriminate if the detected developer density has been inverted in sign or reduced to zero, and, if not, repeating the above-mentioned patch image formation, but, if inverted in sign or reduced to zero, executing the density control with the toner replenishment by the patch detection method.

Then a step S6 discriminates whether the copying of the preset number has been completed, and, if not, the sequence returns to the step S1 to repeat the above-described sequence from the step S1.

Owing to the above-described configuration, also the present embodiment allows to stably replenish the toner of the desired amount to the developing device 4 thereby securely obtaining the image of an appropriate density, regardless of the presence of the toner refilling into the toner hopper 44 or of the individual fluctuation in the toner hopper.

Embodiment 3

In the embodiments 1 and 2, the variation in the developer density is reduced by at first executing the toner replenishment by the first developer density control device of the video count method, then completely terminating the toner replenishment of the video count method and thereafter repeating the toner replenishment by the second developer density control device of the patch detection method.

Figure 6:
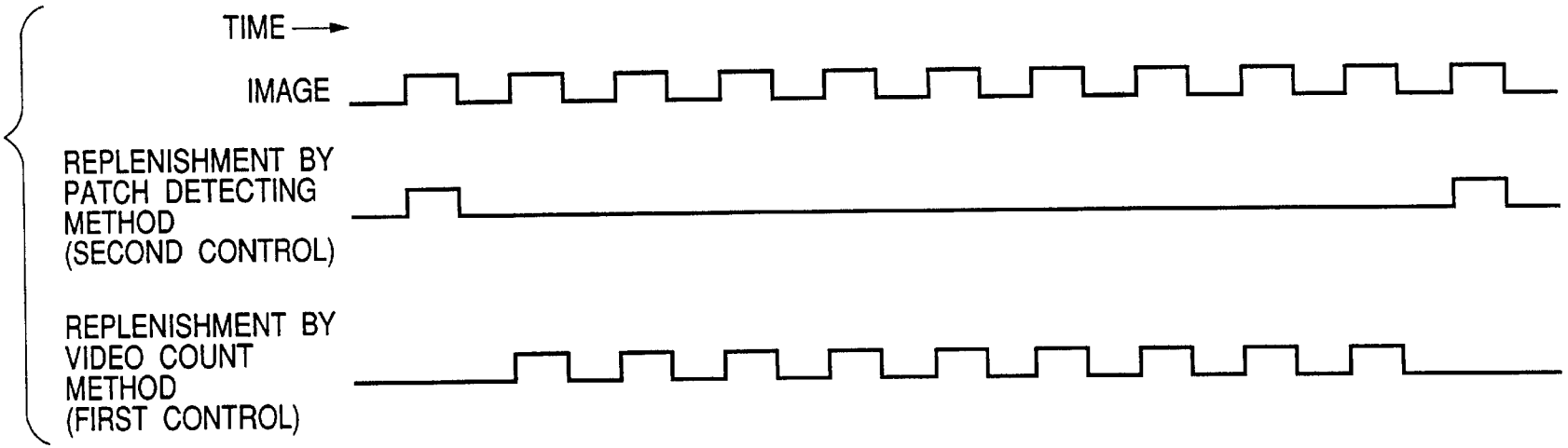
FIG. 6 is a timing chart showing the timing of conrol in the video count mode and the patch detection mode in the density control method in still another embodiment of the present invention.
Figure 7:
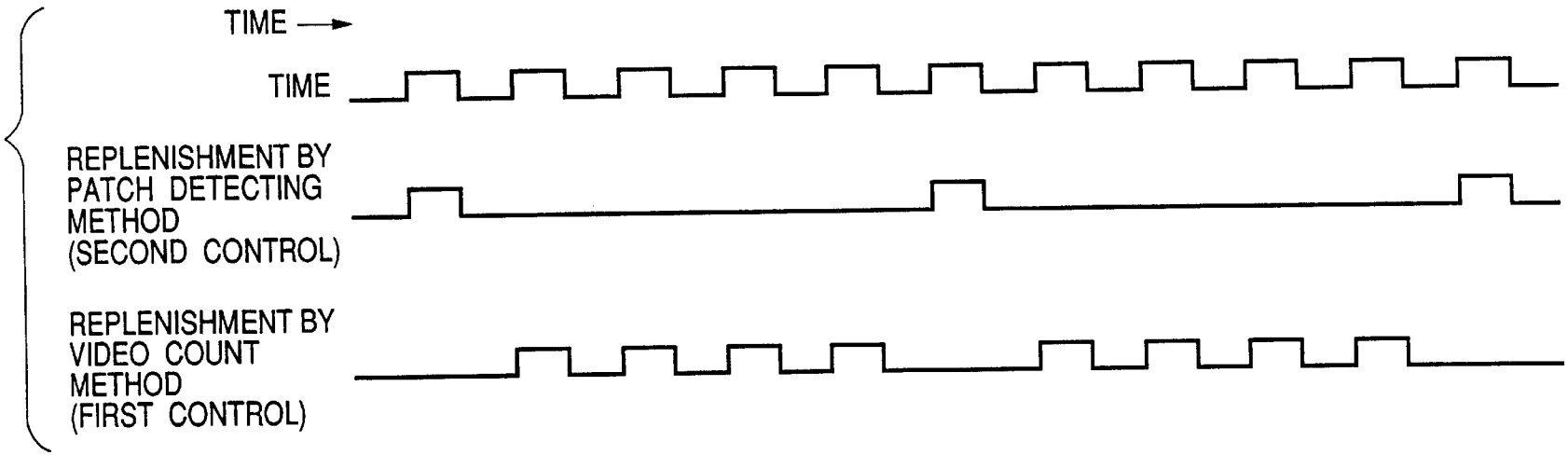
FIG. 7 is a timing chart showing another example of the control timing in the video count mode and the patch detection mode in FIG. 6.

In order to obtain a similar effect, the present embodiment at first executes, as shown in FIG. 6, the toner replenishment of the video count method (first control) every time but also executes the toner replenishment of the patch detection method (second control) for example in every 10 sheets, and, in case the variation in the developer density exceed ±1.0 wt. % or in case the toner refilling into the toner hopper 44 is identified by detecting the remaining toner amount therein, the frequency of the toner replenishment of the patch detection method is switched to every 10 sheets or every 5 sheets as shown in FIG. 7 and further to every 2 sheets.

Thus, also the present embodiment allows to reduce the variation in the developer density, thereby maintaining a stable image density.

As explained above, the foregoing embodiments vary the proportion of use of the first and second developer density control devices based on the variation in the developer density of the developing device 4 or on the toner refilling into the toner hopper 44 detected by the remaining toner amount therein, thereby correcting the fluctuation in the toner replenishing amount from the toner hopper 44 to the developing device 4, thus to reduce the variation in the developer density and to stabilize the image density.

The above-described density control is executed on the developing device 4, but, in case of a full-color image forming apparatus, it is naturally executed on each of the developing devices of four colors.

Also ±1.0 wt. % of the initial value is adopted as the threshold value for switching the developer density control from the video count method to the patch detection method, but the present invention is not limited to such condition and such threshold value may be suitably selected in consideration of the various conditions of the image forming apparatus.

As explained in the foregoing, the embodiments of the present invention are provided with developer density control means of the video count method and developer density control means of the patch detection method, and are adapted to correct the toner replenishment by the developer density control means of the video count method according to the detected density of the density detecting image in the patch detection method and, in case the detected density of the above-mentioned density detecting image exceeds a predetermined value, to terminate the developer density control by the video count method and to control the developer density by the developer density control means of the patch detection method alone or to reduce the frequency of the developer density control of the video count method and increase the frequency of that of the patch detection method, whereby the toner of the desired amount can be stably replenished to the developing device and the image of the appropriate density can be obtained in stable manner, regardless of the presence of the toner refilling into the toner hopper of the developing device or of the individual fluctuation in the toner hopper itself.

Furthermore, there is detected the remaining toner amount in the toner hopper and the obtained detection signal is used for terminating the developer density control by the above-mentioned video count method and executing the developer density control by the patch detection method alone, or decreasing the frequency of the developer density control by the video count method and increasing the frequency of that of the patch detection method, or increasing the frequency of the detection by the patch detection method in case a predetermined threshold value is exceeded in the developer density control of the video count method, thereby achieving stabilization of the developer density by the toner replenishment.

In summary, the present invention provides a toner density control device comprising first toner density control means for controlling the density of the toner in the developer on the basis of the density information of the image signal, and second toner density control means including detecting (detection) means for detecting the density of a formed image and adapted for controlling the density of the toner in the developer on the basis of the image density (the density of the image) detected by the detecting means, and in case the image density detected by the detecting means changes (varies) by not less than a predetermined value with respect to a standard (reference) density, a ratio of the number of density controls by the second density control means with respect to the number of image formations changes.

The above-mentioned detecting means is adapted to detect the density of an image formed on an image bearing member.

The toner replenishment amount by the first toner density control means is corrected according to the image density detected by the detecting means.

The toner replenishment amount by the first toner density control means in response to the integrated value of the density information of the image signal is different depending whether the image density detected by the detecting means is higher or lower than a standard density.

In case the image density detected by the detecting means changes not more than a predetermined value with respect to the standard density, only the density control by the second density control means is executed until the value obtained by subtracting the standard density from the detected density becomes zero or becomes inverted in sign.

There is further provided remaining amount detecting means for detecting the remaining amount of the toner in a developer container, and the ratio (proportion) of the number of density controls by the second density control means with respect to the number of image formations changes also according to the result of detection by the remaining amount detecting means.

The developer, in which toner density is controlled by the toner density control means, is used for developing a latent image on the image bearing member, utilizing an alternating electric field formed in the developing area.

There is also provided a toner density control device comprising first toner density control means for controlling the density of the toner in the developer on the basis of the density information of the image signal, second toner density control means including detecting means for detecting the density of a formed image and adapted for controlling the density of the toner in the developer on the basis of the image density detected by the detecting means, and remaining amount detecting means for detecting the remaining amount of the toner in a developer container, and a ratio of the number of density controls by the second density control means with respect to the number of image formations changes, according to the result of detection by the remaining amount detecting means.

Also the ratio of the number of density controls by the second density control means with respect to the number of image formations changes in case the remaining amount detecting means detects that toner is replenished to the developer container.

Furthermore, the ratio of the number of density controls by the second density control means with respect to the number of image formations changes in case the remaining amount detecting means detects that the toner is replenishied to the developer container within a predetermined number of image formations in the past.

Only the density control by the second toner density control means is executed depending on the result of detection by the remaining amount detecting means.

The ratio of the number of density controls by the second density control means with respect to the number of image formations changes also in case the image density detected by the detecting means changes not less than a predetermined value with respect to the standard density.

The detecting means is adapted to detect the density of an image formed on an image bearing member.

The developer, in which toner density is controlled by the toner density control means, is used for developing a latent image on the image bearing member, utilizing an alternating electric field formed in the developing area.

What is claimed is:

1. A toner density control device comprising:

first toner density control means for controlling density of toner in developer on the basis of density information of image signal; and second toner density control means including detecting means for detecting density of a formed image and adapted for controlling the density of the toner in the developer on the basis of the density of the image detected by said detecting means;

wherein, in case the density of the image detected by said detecting means changes by not less than a predetermined value with respect to a standard density, a ratio of the number of density controls by said second density control means with respect to the number of image formations changes.

2. A toner density control device according to claim 1, wherein said detecting means detects density of an image formed on an image bearing member.

3. A toner density control device according to claim 1, wherein toner replenishment amount by said first toner density control means is corrected according to the image density detected by said detecting means.

4. A toner density control device according to claim 1, wherein toner replenishment amount by said first toner density control means with respect to an integrated value of the density information of the image signal is different between a case where the image density detected by said detecting means is higher than the standard density and a case where that is lower than the standard density.

5. A toner density control device according to claim 1, wherein, in case the density of the image detected by said detecting means changes by not less than a predetermined value with respect to the standard density, only the density control by said second density control means is executed until a value obtained by subtracting the standard density from the detected density becomes zero or becomes inverted in sign.

6. A toner density control device according to claim 1, further comprising remaining amount detecting means for detecting remaining amount of toner in a developer container, wherein a ratio of the number of density controls by said second density control means with respect to the number of image formations changes also depending on a result of detection by said remaining amount detecting means.

7. A toner density control device according to claim 1, wherein the developer in which the density of the toner is controlled by said toner density control means, is used for developing a latent image formed on an image bearing member, utilizing an alternating electric field formed in a developing area.

8. A toner density control device comprising:

first toner density control means for controlling density of toner in developer on the basis of density information of the image signal;

second toner density control means including detecting means for detecting density of a formed image and adapted for controlling the density of the toner in the developer on the basis of the density of the image detected by said detecting means; and remaining amount detecting means for detecting remaining amount of toner in a developer container;

wherein a ratio of the number of density controls by said second density control means with respect to the number of image formations changes, according to a result of detection by said remaining amount detecting means.

9. A toner density control device according to claim 8, wherein, in case said remaining amount detecting means detects that toner is replenished to a developer container, the ratio of the number of density controls by said second density control means with respect to the number of image formations changes.

10. A toner density control device according to claim 9, wherein, in case said remaining amount detecting means detects that toner is replenished to the developer container within a predetermined number of image formations in the past, the ratio of the number of density controls by said second density control means with respect to the number of image formations changes.

11. A toner density control device according to claim 8, wherein only the density control by said second toner density control means is executed depending on the result of detection by said remaining amount detecting means.

12. A toner density control device according to claim 8, wherein the ratio of the number of density controls by said second density control means with respect to the number of image formations changes, also in case the image density detected by said detecting means changes by not less than a predetermined value with respect to a standard density.

13. A toner density control device according to claim 8, wherein said detecting means detects density of an image formed on an image bearing member.

14. A toner density control device according to claim 8, wherein the developer in which the density of the toner is controlled by said toner density control means, is used for developing a latent image formed on an image bearing member, utilizing an alternating electric field formed in a developing area.

* * * * *

UNITED STATES PATENT AND TRADEMARK OFFICE

CERTIFICATE OF CORRECTION

PATENT NO. : 6,075,954

DATED : June 13, 2000

INVENTOR(S) : TAKAO OGATA, ET AL.

It is certified that error appears in the above-identified patent and that said Letters Patent is hereby corrected as shown below:

Cover Item [57] ABSTRACT:
Line 1, "a" should be deleted; and
"first" should read --a first--.

COLUMN 1:
Line 33, "guide by" should read --guided by--.
Line 61, "absorbing" should read --adsorbing--.

COLUMN 2:
Line 22, "an" should read --a--.
Line 24, "an" should read --a--.

COLUMN 3:
Line 29, "tens of" should read --ten--.
Line 45, "enabling" should read --enabling one--.

COLUMN 5:
Line 9, "density thereby" should read --density, thereby--.
Line 53, "formation" should read --formations--.

COLUMN 6:
Line 41, "thus" should read --the thus--.

UNITED STATES PATENT AND TRADEMARK OFFICE

CERTIFICATE OF CORRECTION

PATENT NO. : 6,075,954

DATED : June 13, 2000

INVENTOR(S) : TAKAO OGATA, ET AL.

It is certified that error appears in the above-identified patent and that said Letters Patent is hereby corrected as shown below:

COLUMN 8:

Line 10, "allows to stably" should read --allows one to stably--.

Line 30, "exceed" should read --exceeds--.

Line 38, "allows to reduce" should read --allows one to reduce--.

Line 45, "amount" should read -amount detecting means--.

COLUMN 10:

Line 46, "density" should read --a density--.

Line 47, "toner" should read --a toner--; and "developer" should read --a developer--.

COLUMN 11:

Line 7, "that" should read --the image density--.

UNITED STATES PATENT AND TRADEMARK OFFICE

CERTIFICATE OF CORRECTION

PATENT NO. : 6,075,954

DATED : June 13, 2000

INVENTOR(S) : TAKAO OGATA, ET AL.

It is certified that error appears in the above-identified patent and that said Letters Patent is hereby corrected as shown below:

COLUMN 12:

Line 27, "in case" should read --in a case where--.

Line 34, "developer" should read --developer,--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,075,954
DATED : June 13, 2000
INVENTOR(S) : Takao Ogata et al.

It is certified that error appears in the above-identified patent and that said Letters Patent is hereby corrected as shown below:

Title page,
Item [57], ABSTRACT,
Line 1, “a” should be deleted; and “first” should read -- a first --.

Column 1,
Line 33, “guide by” should read -- guided by --.
Line 61, “absorbing” should read -- adsorbing --.

Column 2,
Lines 22 and 24, “an” should read -- a --.

Column 3,
Line 29, “tens of” should read -- ten --.
Line 45, “enabling” should read -- enabling one --.

Column 5,
Line 9, “density thereby” should read -- density, thereby --.
Line 53, “formation” should read -- formations --.

Column 6,
Line 41, “thus” should read -- the thus --.

Column 8,
Line 10, “allows to stably” should read -- allows one to stably --.
Line 30, “exceed” should read -- exceeds --.
Line 38, “allows to reduce” should read -- allows one to reduce --.
Line 45, “amount” should read -- amount detecting means --.

Column 10,
Line 46, “density” should read -- a density --.
Line 47, “toner” should read -- a toner --; and “developer” should read -- a developer --.

Column 11,
Line 7, “that” should read -- the image density --.

UNITED STATES PATENT AND TRADEMARK OFFICE

CERTIFICATE OF CORRECTION

PATENT NO. : 6,075,954
DATED : June 13, 2000
INVENTOR(S) : Takao Ogata et al.

It is certified that error appears in the above-identified patent and that said Letters Patent is hereby corrected as shown below:

Column 12,
Line 27, “in case” should read -- in a case where --.
Line 34, “developer” should read -- developer, --.

Signed and Sealed this

Twenty-second Day of November, 2005

JON W. DUDAS
*Director of the United States Patent and Trademark Office*